US008152033B2

(12) United States Patent
Funato et al.

(10) Patent No.: US 8,152,033 B2
(45) Date of Patent: Apr. 10, 2012

(54) SLIDING NOZZLE DEVICE AND PLATE USED FOR THE DEVICE

(75) Inventors: Junichi Funato, Fukuoka (JP); Hitoshi Nakamura, Fukuoka (JP); Takashi Kayashima, Fukuoka (JP)

(73) Assignee: Krosakiharima Corporation, Fukuoka (JP)

( * ) Notice: Subject to any disclaimer, the term of this patent is extended or adjusted under 35 U.S.C. 154(b) by 58 days.

(21) Appl. No.: 12/530,503

(22) PCT Filed: Mar. 7, 2008

(86) PCT No.: PCT/JP2008/054145

§ 371 (c)(1),
(2), (4) Date: Mar. 23, 2010

(87) PCT Pub. No.: WO2008/111508

PCT Pub. Date: Sep. 18, 2008

(65) Prior Publication Data

US 2010/0200619 A1 Aug. 12, 2010

(30) Foreign Application Priority Data

Mar. 9, 2007 (JP) ..... 2007-060125

(51) Int. Cl.
*B22D 41/56* (2006.01)

(52) U.S. Cl. ..... 222/591; 222/600; 222/606; 266/236

(58) Field of Classification Search ..... 222/591, 222/594, 599, 536, 537, 526, 533, 534, 600; 164/437, 337; 266/236
See application file for complete search history.

(56) References Cited

U.S. PATENT DOCUMENTS 4,003,561 A * 1/1977 Cudby ..... 222/600
(Continued)

FOREIGN PATENT DOCUMENTS

JP 56-131966 A 10/1981
(Continued)

OTHER PUBLICATIONS

International Search Report published Sep. 18, 2008 for PCT/JP2008/054145 filed Mar. 7, 2008.

(Continued)

*Primary Examiner* — Scott Kastler
*Assistant Examiner* — Michael Aboagye
(74) *Attorney, Agent, or Firm* — Martin Fleit; Paul D. Bianco; Fleit Gibbons Gutman Bongini & Bianco PL

(57) ABSTRACT

It is intended to develop a technique of pressing and fixing a plate by a uniform force to suppress the occurrence of a crack around a nozzle hole of the plate during use, and provide a sliding nozzle device capable of improving durability of the plate, and a plate for use in the sliding nozzle device. The sliding nozzle device comprises a plate (2) and a plate-receiving metal frame (1) for fixedly holding the plate (2). The plate-receiving metal frame (1) is equipped with: at least two holding members (3) each having two pressing surfaces (31, 32) consisting of a longitudinally-pressing surface and a laterally-pressing surface which are protrudingly provided thereon in spaced-apart relation to each other and each adapted to be brought into contact with a corresponding one of a plurality of side surfaces of the plate (2), wherein the holding members (3) are symmetrically arranged with respect to a longitudinal axis of the plate-receiving metal frame (1); a movable block (6) rotatably supporting the holding members (3); and pressing means adapted to press the movable block (6) toward the plate. An angle between the longitudinally-pressing surface (31) and the longitudinal axis of the plate-receiving metal frame (1) is set in the range of 60 to 90 degrees, and an angle between the laterally-pressing surface (32) and the longitudinal axis of the plate-receiving metal frame (1) is set in the range of 1 to 30 degrees.

15 Claims, 4 Drawing Sheets

U.S. PATENT DOCUMENTS

| | | | | | |
|---|---|---|---|---|---|
| 5,004,131 | A | * | 4/1991 | Russo | 222/600 |
| 5,651,909 | A | * | 7/1997 | Taira et al. | 222/600 |

FOREIGN PATENT DOCUMENTS

| | | | | |
|---|---|---|---|---|
| JP | 56131996 | U | | 10/1981 |
| JP | 7116825 | A | | 5/1995 |
| JP | 08-164475 | A | | 6/1996 |
| JP | 10-314927 | | * | 12/1998 |
| JP | 10314927 | A | | 12/1998 |
| JP | 2000233274 | A | | 8/2000 |

OTHER PUBLICATIONS

English translation of the International Preliminary Report on Patentability published Sep. 9, 2009 for PCT/JP2008/054145 filed Mar. 7, 2008.

English translation of the Written Opinion of the International Searching Authority published Sep. 24, 2009 for PCT/JP2008/054145 filed Mar. 7, 2008.

* cited by examiner

Prior Art

SLIDING NOZZLE DEVICE AND PLATE USED FOR THE DEVICE

TECHNICAL FIELD

The present invention relates to a sliding nozzle device for controlling an outflow of molten steel from a vessel, such as a ladle or a tundish, in continuous casting of steel, and a plate for use in the sliding nozzle device.

BACKGROUND ART

Generally, a sliding nozzle device comprises a plurality of refractory plates, a plurality of receiving metal frames for fixedly holding respective ones of the refractory plates, a drive unit for driving one of the receiving metal frames, and pressure applying means for clamping the plates together to apply pressure between respective surfaces of the plates, wherein one of the plates is slidingly moved relative to the remaining plates to selectively open and close a nozzle hole so as to control a flow rate of molten steel, and, during use, a large pressure is applied between the respective surfaces of the plates to prevent leakage of molten steel from a gap between the plates. In the sliding nozzle device, each of the plates is fixedly held by a corresponding one of the receiving metal frame. Typically, the plate primarily comprises a plate brick having a nozzle hole, and includes one type in which a siding surface of the plate brick is tightly bound by a metal band, and another type in which a box-shaped metal casing is attached to the plate brick.

As shown in FIG. 7, one type of sliding nozzle device comprises: an upper plate 72; a lower plate 75; a fixed metal frame 73 mounted to a lower portion of an upper nozzle provided at a bottom of a molten metal vessel 71, to hold the upper plate 72; an opening-closing metal frame 74 provided in an openable/closable manner relative to the fixed metal frame 73; a sliding metal frame 76 provided between the fixed metal frame 73 and the opening-closing metal frame 74 to hold the lower plate 75; an elastic member (not shown) pressing the lower plate 75 against the upper plate 72; and a drive unit 79 for slidingly moving the sliding metal frame 76, wherein the sliding metal frame 76 is slidingly moved to adjust a level of opening based on a relative position between two nozzle holes 77, 78 formed in respective ones of the lower plate 75 and the upper plate 72 so as to control a flow rate of molten metal. The upper and lower plates 72, 75 are fixedly held by respective ones of the fixed metal frame 73 and the sliding metal frame 76. There are also other types, such as a type using three plates, a type having an integrated combination of a lower nozzle and a lower plate, and a type having an integrated combination of a lower plate and an immersion nozzle.

In such types of sliding nozzle devices, as means to fix the plate to the receiving metal frame, there are a longitudinally-pressing mechanism and a laterally-pressing mechanism. The longitudinally-pressing mechanism is primarily intended to prevent displacement of the plate due to a sliding force linearly applied thereto. However, during use, the plate is heated up to high temperatures to undergo thermal expansion, and a force resulting from the thermal expansion acts as a compression force to compress the plate in a longitudinal direction thereof, which is likely to cause the occurrence of a large crack extending in the longitudinal direction in the plate. Moreover, during use, due to the thermal expansion of the plate, a pressing force from the longitudinally-pressing mechanism less subjected to thermal expansion is relatively increased to cause a higher risk of the occurrence of the crack.

With a view to preventing the occurrence of the longitudinal crack as an disadvantage of the longitudinally-pressing mechanism, there has been proposed a technique designed to simultaneously implement the longitudinally-pressing mechanism and the laterally-pressing mechanism, wherein the laterally-pressing mechanism is adapted to apply a pressing force in a lateral direction of the plate using a cotter-type member, as disclosed, for example, in the following Patent Document 1. It is assumed that this technique has an advantage of allowing the occurrence of the longitudinal crack to be suppressed by the lateral pressing force (a laterally outward deformation of the plate due to the longitudinal pressing force to be suppressed by a laterally inward pressing force from the laterally-pressing mechanism) so as to prevent the occurrence of the crack extending from the nozzle hole of the plate in the longitudinal direction. As above, the laterally-pressing mechanism is generally used in combination with the longitudinally-pressing mechanism to complement the disadvantage of the sliding nozzle device employing only the longitudinally-pressing mechanism.

Further, the following Patent Document 2 discloses a clamping mechanism of a sliding nozzle device intended to be used for a refractory plate having a curved outer peripheral surface, wherein a plurality of pressing members arranged around an elliptical or oval-shaped refractory plate are link-connected to each other using pins, and a tension force is applied to the link-connected structure to allow the pressing members to fixedly clamp the refractory plate from a plurality of directions. An advantage of this clamping mechanism is described as follows. The refractory plate can be fixedly clamped from a plurality of directions using a small number of tensioning units to allow a clamping operation to be performed in a simple manner and completed within a significantly short period of time. In addition, there is not a need for providing a plurality of clamping mechanisms each having a different clamping direction as in conventional devices, which makes it possible to facilitate simplification in structure and eliminate a risk of the occurrence of inadvertently unclamped portion. Further, the refractory plate is approximately uniformly clamped over the entire outer periphery thereof, so that local stress on the refractory plate can be reduced as compared with conventional techniques.

[Patent Document 1] JP 2000-233274A

[Patent Document 2] Microfilm of Japanese Utility Model Application No. 55-027468 (JU 56 131966A)

DISCLOSURE OF THE INVENTION

[Problem to be Solved by the Invention]

The technique disclosed in the Patent Document 1 cannot fully prevent the occurrence of a crack, due to difficulty in adjusting a balance between the longitudinal and lateral pressing forces. Moreover, a clamping unit is provided independently for each of the longitudinally-pressing mechanism and the laterally-pressing mechanism, and thereby it is necessary to take a long time for an attaching/detaching operation for the plate.

In the technique disclosed in the Patent Document 2, a sliding force of the plate is received by only one side of the link-connected chain-like structure, which is liable to cause loosening of the chain-like structure, and displacement of the plate brick due to the sliding force. If the chain-like structure is loosened, a gap is likely to occur in a contact region with an upper or lower nozzle due to the displacement of the plate brick, which leads to a risk of leakage of molten steel. Moreover, a fracture of the refractory brick itself is likely to occur in a fitted portion with the upper or lower nozzle.

It is an object of the present invention to develop a technique of pressing and fixing a plate by a uniform force to suppress the occurrence of a crack around a nozzle hole of the plate during use, and provide a sliding nozzle device capable of improving durability of the plate, and a plate for use in the sliding nozzle device.

[Means for Solving the Problem]

In order to achieve the above object, the present invention provides a sliding nozzle device which comprises a plate, and a plate-receiving metal frame for fixedly holding the plate. The sliding nozzle device is characterized in that the plate-receiving metal frame is equipped with: at least two holding members each having two pressing surfaces consisting of a longitudinally-pressing surface and a laterally-pressing surface which are protrudingly provided thereon in spaced-apart relation to each other and each adapted to be brought into contact with a corresponding one of a plurality of side surfaces of the plate, wherein the holding members are symmetrically arranged with respect to a longitudinal axis of the plate-receiving metal frame; a movable block rotatably supporting the holding members; and pressing means adapted to press the movable block toward the plate, wherein an angle between the longitudinally-pressing surface and the longitudinal axis of the plate-receiving metal frame is set in the range of 60 to 90 degrees, and an angle between the laterally-pressing surface and the longitudinal axis of the plate-receiving metal frame is set in the range of 1 to 30 degrees.

EFFECT OF THE INVENTION

Based on a structure of the holding member and an arrangement of the holding members, the present invention can suppress the occurrence of a crack in the plate to improve durability of the plate.

BEST MODE FOR CARRYING OUT THE INVENTION

The present invention will be described based on an embodiment thereof

[First Embodiment]

FIG. 1 is a top plan view showing a plate and a plate-receiving metal frame in a sliding nozzle device according to a first embodiment of the present invention. In FIG. 1, a sliding metal frame is illustrated as the plate-receiving metal frame used in the sliding nozzle device.

As shown in FIG. 1, the plate-receiving metal frame 1 has a front wall 11 and a rear wall 12 located in front-to-rear relation in a sliding direction of the plate 2, right and left lateral walls 13 located in left-to-right relation with respect to the sliding direction, and a bottom wall 14, wherein the plate-receiving metal frame 1 is formed by connecting each of the front wall 11, the rear wall 12 and the lateral walls 13 onto an outer peripheral region of the bottom wall 14, to have a rectangular shape in top plan view. The plate 2 is fixed to an approximately central region of the plate-receiving metal frame 1 by four holding members 3. The plate-receiving metal frame 1 has one longitudinal end provided with connection portion 4 for connection with a drive unit. The plate-receiving metal frame 1 is adapted to be slidingly moved within the sliding nozzle device in the arrowed direction A.

The plate 2 has a dodecagonal shape formed by cutting off four corners of an octagonal shape. Among twelve side surfaces of the dodecagonal-shaped plate 2, eight side surfaces are fixed by respective ones of eight pressing surfaces of the four holding members 3. Specifically, in the plate 2 illustrated in FIG. 1, eight side surfaces, except two side surfaces 21 parallel to the sliding direction (arrowed direction A) and two side surfaces 22 perpendicular to the sliding direction, are fixed by corresponding ones of after-mentioned four longitudinally-pressing surfaces 31 and after-mentioned four laterally-pressing surfaces 32.

More specifically, the holding member 3 is provided in a total number of four, wherein a first group of two of the four holding members and a second group of the remaining two holding members are arranged on respective ones of opposite sides of a nozzle hole 23 of the plate 2 in the sliding direction, and wherein the two holding members in each of the first and second groups are symmetrically arranged with respect to a longitudinal axis C of the plate-receiving metal frame 1. Each of the holding members 3 has a generally L shape. A through-hole is formed in an approximately central region of the holding member 3 to extend in a direction perpendicular to a sliding surface of the plate, and a pivot shaft 33 inserted into the through-hole to allow the holding member 3 to be pivotally supported by a fixed block 5 or a movable block 6 in a rotatable manner in a plane parallel to the sliding surface. In the first embodiment illustrated in FIG. 1, each of the four holding members 3 has the same shape.

The number of the holding members 3 to be used in a sliding nozzle device of the present invention is at least two. For example, one of the longitudinally opposite ends of the plate 2 may be fixed using the two holding member 3 symmetrically arranged with respect to the longitudinal axis of the plate-receiving metal frame, and the other end may be fixed using a conventional holding mechanism. In this case, an effect of suppressing the occurrence of a crack in a longitudinal direction of the plate (longitudinal-crack suppressing effect) can be sufficiently obtained. Further, as in the first embodiment, the four holding members 3 may be used in such a manner that a first group of two of the four holding members and a second group of the remaining two holding members are arranged on respective ones of opposite sides of the nozzle hole in the sliding direction of the plate, wherein the two holding members in each of the first and second groups are symmetrically arranged with respect to the longitudinal axis of the plate-receiving metal frame. In this case, the longitudinal-crack suppressing effect can be enhanced.

The fixed block 5 consists of two fixed sub-blocks symmetrically arranged with respect to the longitudinal axis C of the plate-receiving metal frame 1. Each of the fixed sub-blocks 5 has one end which is fixed to the front wall 11 of the plate-receiving metal frame 1 by a fixing bolt 51, and the other end which pivotally holds the pivot shaft 33 of a corresponding one of the two holding members 3 of the first group.

The movable block 6 is formed in a generally angular C shape in top plan view to have opposite ends each holding the pivot shaft 33 of a corresponding one of the two holding members 3 of the second group. The movable block 6 has two clamp bolts 61 provided on the side of the rear wall to serve as pressing means. The rear wall 12 has two through-holes, and the clamp bolts 61 are movably inserted into respective ones of the through-holes. Further, two nuts 62 are screwed onto each of the clamp bolts 61 on respective ones of opposite sides of the rear wall. The movable block 6 is in contact with the bottom wall 14 of the plate-receiving metal frame 1. Thus, the nuts 62 on the respective clamp bolts 61 can be rotated to move the clamp bolts 61 forwardly and backwardly (frontwardly and rearwardly), so that the movable block 6 can be moved forwardly and backwardly. Accordingly, the plate 2 is allowed to be attached/detached, and the holding members 3 can be pressed against the plate 2.

A gap of about 1 mm is formed between each of the holding members 3 and a corresponding one of the lateral walls 13 and between the movable block 6 and each of the lateral walls 13. Although the sliding nozzle device according to the first embodiment employs the bolt mechanism as the pressing means, any other conventional technique for use in attaching and detaching a plate, such as a cam-based pressing mechanism disclosed in JP 07-116825A, may also be employed.

As shown in FIGS. 1 and 2, each of the four holding members 3 has two surfaces consisting of a longitudinally-pressing surface 31 for pressing the plate 2 in the longitudinal direction of the plate 2 and a laterally-pressing surface 32 for pressing the plate 2 in a lateral (widthwise) direction of the plate 2, which are protrudingly provided thereon. In the first embodiment, an angle β between the longitudinally-pressing surface 31 and the longitudinal axis C of the plate-receiving metal frame is set at 70 degrees, and an angle γ between the laterally-pressing surface 32 and the longitudinal axis C of the plate-receiving metal frame is set at 10 degrees. In FIG. 2, the longitudinal axis C is translated for purposes of illustration.

Preferably, the angle β between the longitudinally-pressing surface 31 and the longitudinal axis C of the plate-receiving metal frame is set in the range of 60 to 90 degrees. If the angle β set at a value greater than 90 degrees, stress is liable to concentrate in a central region of the plate to cause a longitudinal crack. If the angle β is set at a value less than 60 degrees, a pressing force becomes insufficient, and thereby displacement of the plate is likely to occur during sliding.

Preferably, the angle γ between the laterally-pressing surface 32 and the longitudinal axis C of the plate-receiving metal frame is set in the range of 1 to 30 degrees. If the angle γ is set at a value less than 1 degree, clamping is performed in a direction approximately parallel to the sliding direction, and thereby it becomes difficult to produce a pressing force toward a center of the plate. If the angle γ is set at a value greater than 30 degree, a pressing force toward an inside of the plate becomes lower, and thereby the longitudinal-crack suppressing effect is deteriorated.

In order to allow the holding member 3 to be rotated so as to more effectively produce a stress release effect, it is preferable that each of the pressing surfaces 31, 32 protrudingly provided on the holding member is arranged with a distance from the pivot shaft 33, as shown in FIG. 2. In this regard, preferably, a distance X between the pivot shaft 33 and a proximal edge of the longitudinally-pressing surface 31 is set in the range of 20 to 100 mm, and a distance Y between the pivot shaft 33 and a proximal edge of the laterally-pressing surface 32 is set in the range of 50 to 200 mm.

More preferably, an inner angle α of the holding member 3 having a generally L shape is set in the range of 100 to 160 degrees to allow the holding member 3 to fix the plate by a uniform force. Although a position of the pivot shaft 33 is not particularly limited, the pivot shaft 33 may be arranged in a corner of the plate or in the vicinity thereof to allow the holding member 3 to hold the plate in a balanced manner.

FIG. 3 shows the plate 2 used in the first embodiment illustrated in FIG. 1. The plate 2 has a dodecagonal shape formed by preparing a plate material formed in an octagonal shape in top plan view to have a first diagonal line A parallel to a sliding direction of the plate, and a second diagonal line B intersecting with the first diagonal line A at a right angle, and cutting off four corners of the plate material on the first and second diagonal lines. In the plate, a length ratio A/B of the first diagonal line A to the second diagonal line B is set at 2, and second diagonal line B intersecting with the first diagonal line A at a midpoint of the first diagonal line A.

In the first embodiment, during an operation of fixing the plate, the plate 2 can be pressed by the longitudinally-pressing surfaces and the laterally-pressing surfaces in the two or four holding members, so that a longitudinal pressing force and a lateral pressing force can be effectively applied to the plate in such a manner as to release longitudinal stress in the plate.

Although the plate 2 is formed in a compact shape by cutting off the four corners of the octagonal-shaped plate material, the octagonal-shaped plate martial before cutting off the four corners can be directly used as the plate 2 without any problem. Further, instead of cutting off the four corners, each of the four corners may be rounded. Furthermore, the plate may have two or more nozzle holes.

The length ratio of the first diagonal line to the second diagonal line may be set at 1.5 or more. In this case, a sliding range (stroke) can be sufficiently ensured in the longitudinal direction of the plate. If the length ratio is set at a value less than 1.5, a width of the plate will be excessively increased due to a need for ensuring a required stroke, to cause an increase in size of the plate, which is undesirable in economical aspect.

In case where the second diagonal line B is located at the midpoint of the first diagonal line A or at a position falling within ±10 mm from the midpoint, the plate has a longitudinally/laterally symmetrical shape, so that stresses by the pressing surfaces at the eight positions are uniformly distributed, and therefore a crack becomes less likely to occur in the plate.

[Second Embodiment]

FIG. 4 shows a plate and a holding member for use in a sliding nozzle device according to a second embodiment of the present invention. The plate 2*a* has a contour in top plan view, which is defined by: two first curved line segments each having a first curvature radius r of 65 mm and defining a respective one of opposite edge regions of the plate in a direction of a longitudinal axis of the plate; two second curved line segments each having a second curvature radius R of 370 mm and defining a respective one of opposite edge regions of the plate in a direction perpendicular to the direction of the longitudinal axis; and four short straight line segments connecting the first and second curved line segments to each other. The plate 2*a* has a nozzle hole with an inner diameter D of 35 mm. A straight line segment S1 extending between respective centers of the two second curvature radii R intersects with a straight line segment S2 extending between respective centers of the two first curvature radii r, at a midpoint of the straight line segment S2 and at a right angle. The straight line segment S2 between the centers of the two first curvature radii r is aligned with a longitudinal axis of the plate. The holding member 3 has a longitudinally-pressing surface 31 capable of pressing one of two first curved portions of the plate which are the longitudinally opposite edge regions of the plate each having the first curvature radius r, and a laterally-pressing surface 32 capable of pressing a second portion of the plate other than the first curved portions.

Preferably, the plate has a contour in top plan view, which is defined by a line including two first curved line segments each having a first curvature radius and defining a respective one of opposite edge regions of the plate in a direction of the longitudinal axis of the plate, and two second curved line segments each having a second curvature radius and defining a respective one of opposite edge regions of the plate in a direction perpendicular to the direction of the longitudinal axis, wherein the contour satisfies the following relationship: $D<r<3D$, and $3r<R<8r$, wherein: r is the first curvature radius; R is the second curvature radius; and D is a diameter of the nozzle hole of the plate. Further, the plate may be formed in a shape where a straight line segment S1 extending between respective centers of the two second curvature radii R intersects with a straight line segment S2 extending between respective centers of the two first curvature radii r, at a position of the straight line segment S2 falling within ±20 mm from a midpoint of the straight line segment S2 and approximately at a right angle. The plate is formed in the above shape, so that one of the first curved portions of the plate which are the longitudinally opposite edge regions of the plate each having the first curvature radius r, and the second portion of the plate other than the first curved portions, can be pressed by the longitudinally-pressing surface 31 and the laterally-pressing surface 32, respectively.

If the first curvature radius r in each of the longitudinally opposite edge regions of the plate is set at a value equal to or less that the diameter D of the nozzle hole, a distance between an inner peripheral surface of the nozzle hole and an outer peripheral surface of the plate becomes smaller, and thereby the strength of the plate is liable to become insufficient to cause the occurrence of a crack extending from the inner peripheral surface of the nozzle hole toward the outer peripheral surface of the plate. If the first curvature radius r is set at a value equal to or greater than 3D, the plate is excessively increased in size, which is undesirable in economical aspect.

If the second curvature radius R in each of the opposite edge regions of the plate in the direction perpendicular to the direction of the longitudinal axis is equal to or less than 3r, a length of the plate is excessively reduced in terms of a stroke required for slidingly moving the plate, and thereby the strength of the plate becomes insufficient to cause deterioration in durability of the plate. If the second curvature radius R is set at a value equal to or greater than 8r, the plate is excessively increased in size, which is undesirable in economical aspect.

In an operation of fixing the plate to the plate-receiving metal frame 1, the nuts 62 on the clamp bolts in FIG. 1 are rotated to allow the movable block 6 to be moved toward the connection portion 4, so that the holding members 3 supported by the movable block 6 are also moved toward the connection portion. Subsequently, the plate is inserted, and then the nuts 62 are tightened to press the plate and fixedly hold the plate by the holding members. In an operation of detaching the plate, the nuts 62 are loosened.

With reference to FIG. 5, an effect of suppressing a longitudinal crack in the plate 2 during use of the sliding nozzle device according to the first or second embodiment will be described below. In FIG. 5, when the plate-receiving metal frame 1 is moved leftwardly, the plate receives a force in the arrowed direction F, which is a frictional force by a movement relative to an opposed plate in slide contact therewith. This force is received by the longitudinally-pressing surfaces of the two holding members 3, in such a manner as to allow a part of the force to be released in the arrowed direction G. Thus, based on a leverage action of the holding member where the pivot shaft 33 serves as a fulcrum, a force in the arrowed direction H is applied to each of the laterally-pressing surfaces of the holding members.

In the above manner, a part of compression stress generated in the longitudinal direction is released in the arrowed direction G, and a compression force is applied to respective opposite side surfaces the plate from the arrowed directions H. This makes it possible to suppress the occurrence of a longitudinal crack in the plate. In other words, the holding member having the pivot shaft can distribute a load applied to one of the two pressing surfaces, to the other pressing surface.

In the same way, when the plate is expanded in the longitudinal direction due to thermal expansion during use, the rotation mechanism of each of the two holding members is operable to release longitudinal compression stress, while converting a part of the longitudinal compression stress to a lateral pressing force for suppressing the occurrence of a longitudinal crack.

The above mechanism makes it possible to suppress the occurrence of a crack in the plate so as to improve durability of the plate.

[Third Embodiment]

FIG. 6 shows a holding member in a sliding nozzle device according to a third embodiment of the present invention. The sliding nozzle device according to the third embodiment comprises a plate 2, a plate-receiving metal frame 1, a fixed block 5, a movable flock 6, a first group of two holding members 3 and a second group of two holding members 3. The fixed block 5 is made of a metal, and fixed to a wall of the plate-receiving metal frame 1 on a longitudinal axis of the plate-receiving metal frame 1 to have a gap 5*a* with respect to a wall surface of the plate-receiving metal frame 1. The two holding members 3 of the first group are rotatably supported by respective ones of laterally opposite ends of the fixed block 5, in the same manner as that for the holding members in FIG. 1. Each of the holding members 3 of the first group is formed to have a longitudinally-pressing surface 31 and a laterally-pressing surface 32, and supported in such a manner as to be kept from coming into contact with the wall of the plate-receiving metal frame 1.

The movable block 6 is made of a metal, and supported by a screw block 6*b* on the longitudinal axis through a bolt 6*c* to have a gap 6*a* with respect to the wall surface of the plate-receiving metal frame 1. The two holding members 3 of the second group are rotatably supported by respective ones of laterally opposite ends of the movable block 6, in the same manner as that in the fixed block 5. The holding member 3 supported by the movable block 6 has the same structure and shape as those of the holding member 3 supported by the fixed block 5.

The screw block 6*b* is fixed to the plate-receiving metal frame 1. The screw block 6*b* has a through-hole formed with an internal thread groove for allowing the bolt 6*c* to be screwed thereinto. The screw block 6*b* has two guide members which are provided on both sides of the through-hole to protrude therefrom, and inserted into the movable block 6.

The bolt 6*c* is formed with an external thread groove, and screwed into the through-hole of the screw block 6*b*. Each of the movable block 6 and the wall of the plate-receiving metal frame 1 has a through-hole formed therein without an internal thread groove to allow the bolt 6*c* to rotatably penetrate through the through-hole. The bolt 6*c* has two flanges formed on a distal end thereof at respective positions on opposite sides of the movable block 6.

The movable block 6 can be moved by moving the bolt 6*c* according a rotation thereof to bring either one of the two flanges of the bolt 6*c* into contact with the movable block 6. Thus, the plate 2 can be selectively attached and detached by rotating the bolt 6*c* to move the movable block 6.

The plate 2 has a contour in top plan view, which is defined by a line including two first curved line segments each having a first curvature radius r of 80 mm and defining a respective one of opposite edge regions of the plate in a direction of a longitudinal axis of the plate, and two second curved line segments each having a second curvature radius R of 600 mm and defining a respective one of opposite edge regions of the plate in a direction perpendicular to the direction of the longitudinal axis, wherein the contour satisfies the same relationship of r, R and D as that in the plate illustrated in FIG. 4. A nozzle hole of this plate has an inner diameter D of 60 mm.

Even if the plate is expanded due to thermal expansion during use, the fixed block or the movable block is warped by a resulting expansion force applied thereto, to absorb stress generated in the plate. This makes it possible to prevent the occurrence of a crack in the plate. The gap is formed between each of the fixed block and the movable block, and the wall of the plate-receiving metal frame, so that each of the fixed block and the movable block can be warped by the thermal expansion force of the plate received from the holding members.

Explanation of Codes

Figure 1:
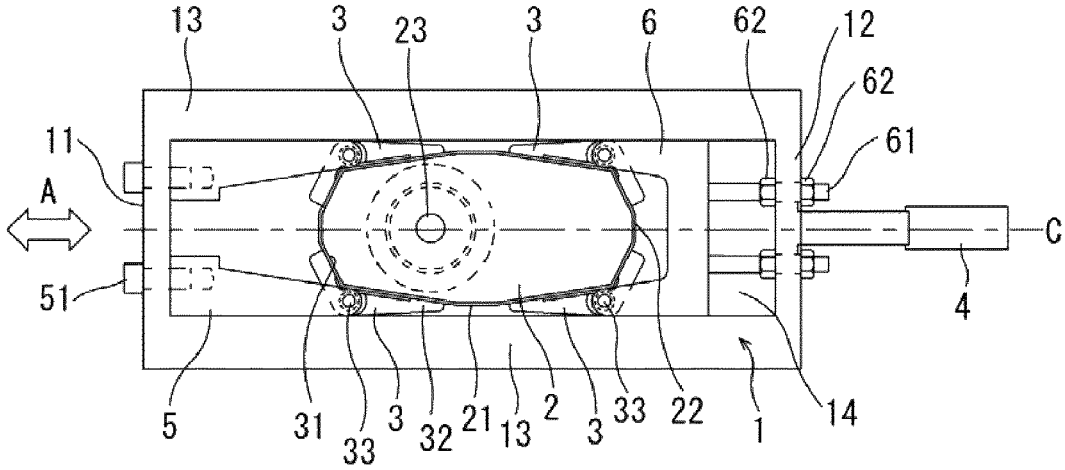
FIG. 1 is a top plan view showing a plate and a plate-receiving metal frame in a sliding nozzle device according to a first embodiment of the present invention.
Figure 2:
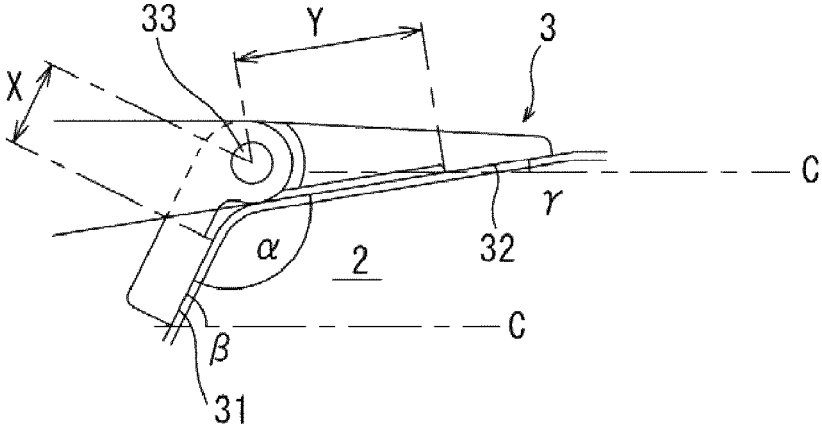
FIG. 2 is an enlarged view showing a holding member in the sliding nozzle device illustrated in FIG. 1.
Figure 3:
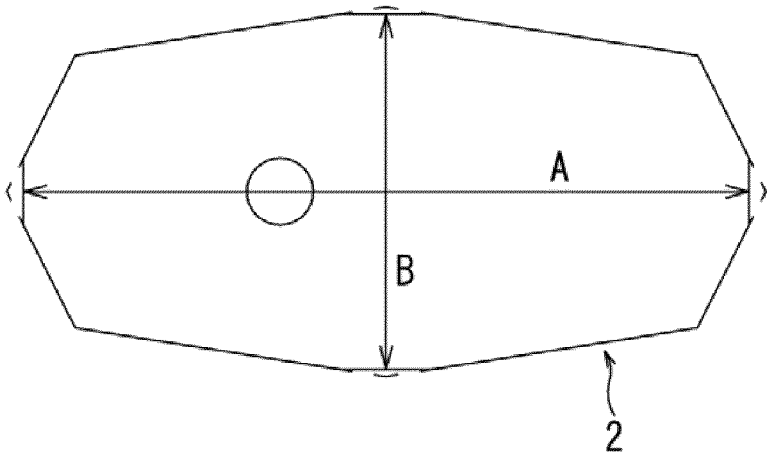
FIG. 3 is a top plan view showing the plate in the first embodiment.
Figure 4:
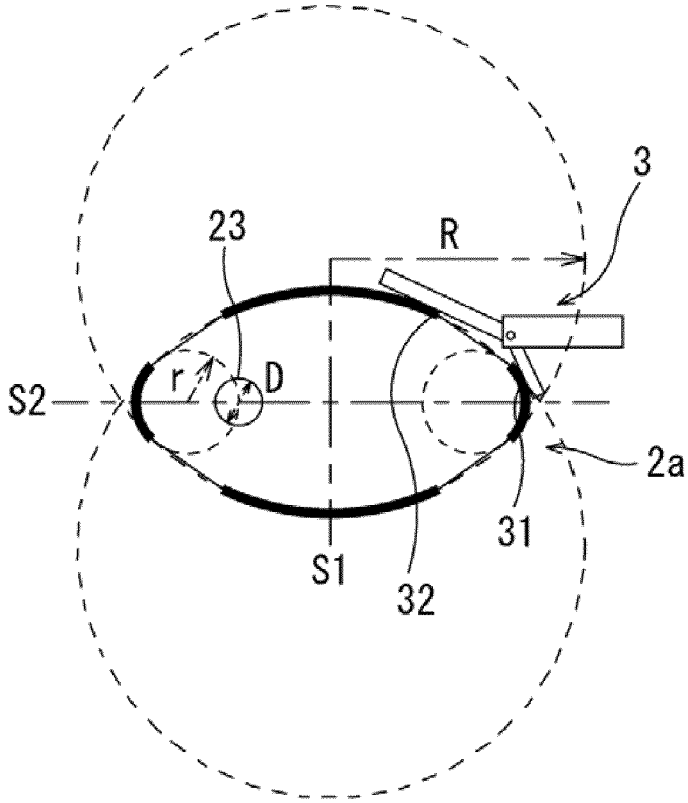
FIG. 4 is a top plan view showing a plate in a sliding nozzle device according to a second embodiment of the present invention.
Figure 5:
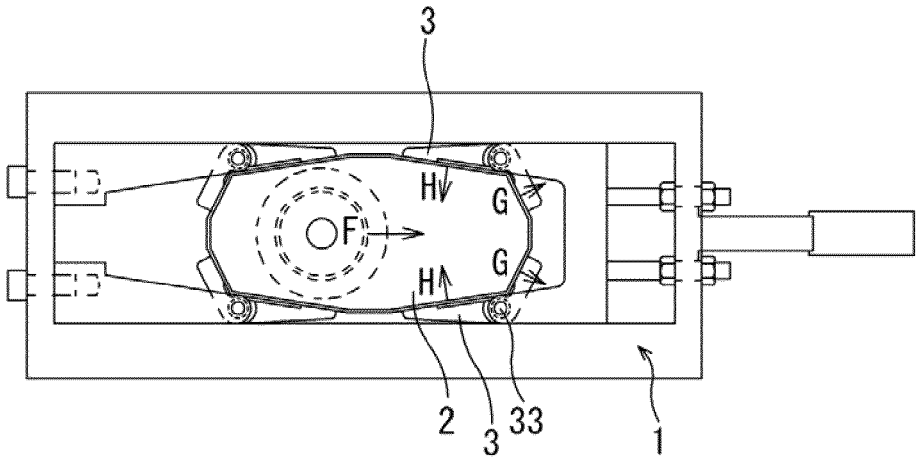
FIG. 5 is an explanatory diagram of a stress releasing mechanism.
Figure 6:
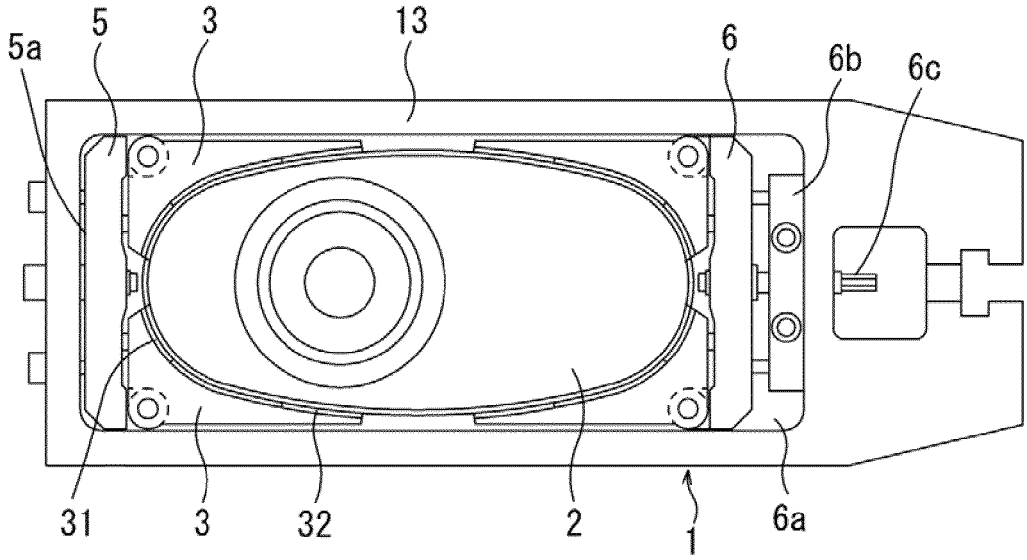
FIG. 6 is a top plan view showing blocks in a sliding nozzle device according to a third embodiment of the present invention.
Figure 7:
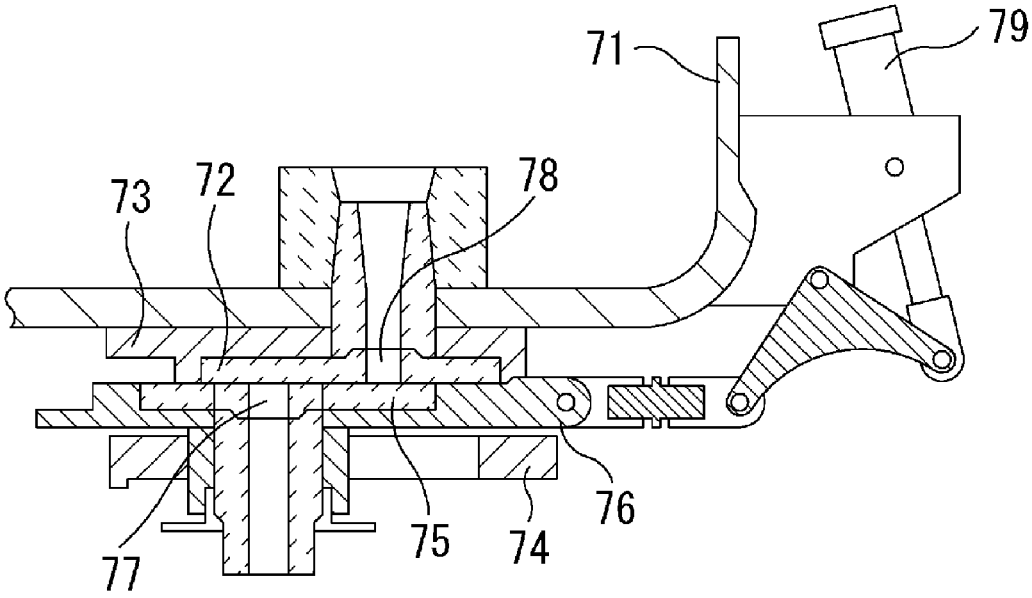
FIG. 7 is an explanatory diagram showing one example of a conventional sliding nozzle device.

1: plate-receiving metal frame
11: front wall
12: rear wall
13: lateral wall
14: bottom wall
2: plate
2*a*: plate
21: side surface parallel to sliding direction
22: side surface perpendicular to sliding direction
23: nozzle hole
3: holding member
31: longitudinally-pressing surface
32: laterally-pressing surface
33: pivot shaft
4: connection portion
5: fixed block
5*a*: gap
51: fixing bolt
6: movable block
6*a*: gap
6*b*: screw block
6*c*: bolt
61: clamp bolt
62: nut
71: molten metal vessel
72: upper plate
73: fixed metal frame
74: opening-closing metal frame
75: lower plate
76: sliding metal frame
77: nozzle hole
79: drive unit

The invention claimed is:

1. A sliding nozzle device for casting, comprising:

a plate;

a plate-receiving metal frame for fixedly holding the plate, a movable block positionable within said frame;

at least two holding members each having two pressing surfaces consisting of a longitudinally-pressing surface configured to press against a longitudinal surface of the plate, and a laterally-pressing surface configured to press against a lateral surface of the plate, the longitudinally-pressing surface and the laterally-pressing surface extending in spaced-apart relation to each other, wherein the holding members are arranged on opposite sides with respect to a longitudinal axis of the plate-receiving metal frame, said at least two holding members pivotably connected to said movable block about a pivot axis; and pressing means connected to the frame and adapted to press the movable block toward the plate, wherein an angle between the longitudinally-pressing surface and the longitudinal axis of the plate-receiving metal frame is set in the range of 60 to 90 degrees, and an angle between the laterally-pressing surface and the longitudinal axis of the plate-receiving metal frame is set in the range of 1 to 30 degrees.

2. The sliding nozzle device as defined in claim 1, wherein the holding members are provided in a total number of four, and wherein a first group of two of the four holding members and a second group of the remaining two holding members are arranged on respective ones of opposite sides of a nozzle hole of the plate in a sliding direction of the plate, and wherein the two holding members in each of the first and second groups are symmetrically arranged with respect to the longitudinal axis.

3. The sliding nozzle device as defined in claim 2, wherein the plate-receiving metal frame is further equipped with a fixed block made of a metal, and the movable block is made of a metal, and wherein the two holding members of the first group are rotatably supported by respective ones of laterally opposite ends of the fixed block, and the two holding members of the second group are rotatably supported by respective ones of laterally opposite ends of the movable block, and wherein the fixed block is fixed to a wall of the plate-receiving metal frame on the longitudinal axis to have a gap with respect to a wall surface of the plate-receiving metal frame, and the movable block is movably fixed to the wall of the plate-receiving metal frame on the longitudinal axis to have a gap with respect to the wall surface of the plate-receiving metal frame.

4. The sliding nozzle device as defined in claim 1, wherein the plate is formed in a generally octagonal shape in top plan view to have a first diagonal line A parallel to a sliding direction of the plate, and a second diagonal line B perpendicular to the first diagonal line A, and wherein a length ratio A/B of the first diagonal line A to the second diagonal line B is set at 1.5 or more.

5. The sliding nozzle device as defined in claim 4, wherein each of four corners of the plate on the first and second diagonal lines is cut off.

6. The sliding nozzle device as defined in claim 4, which is designed to be used in continuous casting.

7. The sliding nozzle device as defined in claim 2, wherein the plate is formed in a generally octagonal shape in top plan view to have a first diagonal line A parallel to a sliding direction of the plate, and a second diagonal line B perpendicular to the first diagonal line A, and wherein a length ratio A/B of the first diagonal line A to the second diagonal line B is set at 1.5 or more.

8. The sliding nozzle device as defined in claim 7, wherein each of four corners of the plate on the first and second diagonal lines is cut off.

9. The sliding nozzle device as defined in claim 5, which is designed to be used in continuous casting.

10. The sliding nozzle device as defined in claim 7, which is designed to be used in continuous casting.

11. The sliding nozzle device as defined in claim 8, which is designed to be used in continuous casting.

12. A sliding nozzle device for casting, comprising:

a plate;

a plate-receiving metal frame for fixedly holding the plate, a movable block positionable within said frame;

at least two holding members each having two pressing surfaces consisting of a longitudinally-pressing surface configured to press against a longitudinal surface of the plate, and a laterally-pressing surface configured to press against a lateral surface of the plate, the longitudinally-pressing surface and the laterally-pressing surface extending in spaced-apart relation to each other, wherein the holding members are arranged on opposite sides with respect to a longitudinal axis of the plate-receiving metal frame, said at least two holding members pivotably connected to said movable block about a pivot axis; and pressing means connected to the frame and adapted to press the movable block toward the plate, wherein an angle between the longitudinally-pressing surface and the longitudinal axis of the plate-receiving metal frame is set in the range of 60 to 90 degrees, and an angle between the laterally-pressing surface and the longitudinal axis of the plate-receiving metal frame is set in the range of 1 to 30 degrees, and wherein the plate has a contour in top plan view, which is defined by a line including two first curved line segments each having a first curvature radius r and defining a respective one of opposite edge regions of the plate in a direction of a longitudinal axis of the plate, and two second curved line segments each having a second curvature radius R and defining a respective one of opposite edge regions of the plate in a direction perpendicular to the direction of the longitudinal axis, the contour satisfying the following relationship: $D<r<3D$, and $3r<R<8r$, wherein D is a diameter of a nozzle hole of the plate.

13. The sliding nozzle device as defined in claim 12, which is designed to be used in continuous casting.

14. A sliding nozzle device for casting, comprising:

a plate;

a plate-receiving metal frame for fixedly holding the plate, a movable block positionable within said frame;

at least two holding members each having two pressing surfaces consisting of a longitudinally-pressing surface configured to press against a longitudinal surface of the plate, and a laterally-pressing surface configured to press against a lateral surface of the plate, the longitudinally-pressing surface and the laterally-pressing surface extending in spaced-apart relation to each other, wherein the holding members are arranged on opposite sides with respect to a longitudinal axis of the plate-receiving metal frame, said at least two holding members pivotably connected to said movable block about a pivot axis; and pressing means connected to the frame and adapted to press the movable block toward the plate, wherein an angle between the longitudinally-pressing surface and the longitudinal axis of the plate-receiving metal frame is set in the range of 60 to 90 degrees, and an angle between the laterally-pressing surface and the longitudinal axis of the plate-receiving metal frame is set in the range of 1 to 30 degrees, and wherein the plate is formed in a generally octagonal shape in top plan view to have a first diagonal line A parallel to a sliding direction of the plate, and a second diagonal line B perpendicular to the first diagonal line A, and wherein a length ratio A/B of the first diagonal line A to the second diagonal line B is set at 1.5 or more, and wherein each of four corners of the plate on the first and second diagonal lines is cut off, and wherein the plate has a contour in top plan view, which is defined by a line including two first curved line segments each having a first curvature radius r and defining a respective one of opposite edge regions of the plate in a direction of a longitudinal axis of the plate, and two second curved line segments each having a second curvature radius R and defining a respective one of opposite edge regions of the plate in a direction perpendicular to the direction of the longitudinal axis, the contour satisfying the following relationship: $D<r<3D$, and $3r<R<8r$, wherein D is a diameter of a nozzle hole of the plate.

15. The sliding nozzle device as defined in claim 14, which is designed to be used in continuous casting.

* * * * *